US006012395A

United States Patent [19]

Saxby

[11] Patent Number: 6,012,395

[45] Date of Patent: Jan. 11, 2000

[54] BATON PROJECTILE

[75] Inventor: Michael Ernest Saxby, East Sussex, United Kingdom

[73] Assignee: Constantia (International) Limited, Queensway, Gibraltar

[21] Appl. No.: 09/210,743

[22] Filed: Dec. 15, 1998

Related U.S. Application Data

[63] Continuation of application No. 08/571,962, filed as application No. PCT/GB94/01377, Jun. 27, 1994, abandoned.

[30] Foreign Application Priority Data

Jun. 28, 1993 [GB] United Kingdom ..... 9313310

[51] Int. Cl.[7] ..... F42B 8/12

[52] U.S. Cl. ..... 102/502; 102/444; 102/529

[58] Field of Search ..... 102/395, 439, 102/444–447, 501, 502, 506–510, 513–517, 529

[56] References Cited

U.S. PATENT DOCUMENTS

| | | | |
|---|---|---|---|
| 1,512,026 | 10/1924 | Holden et al. | 102/509 |
| 3,714,896 | 2/1973 | Young | 102/517 |
| 3,782,286 | 1/1974 | Jones et al. . | |
| 3,865,038 | 2/1975 | Barr | 102/502 |
| 3,906,859 | 9/1975 | Smith . | |
| 3,911,824 | 10/1975 | Barr et al. | 102/502 |
| 3,951,070 | 4/1976 | Flatan et al. | 102/502 |
| 4,823,702 | 4/1989 | Woolsey | 102/502 |
| 5,035,183 | 7/1991 | Luxton | 102/502 |
| 5,086,703 | 2/1992 | Klein | 102/502 |
| 5,121,692 | 6/1992 | DiCarlo | 102/513 |
| 5,221,809 | 6/1993 | Cuadros | 102/439 |

FOREIGN PATENT DOCUMENTS

| | | | |
|---|---|---|---|
| 103509 | 3/1984 | European Pat. Off. | 102/502 |
| 488911 | 6/1992 | European Pat. Off. | 102/502 |
| 499332 | 8/1992 | European Pat. Off. . | |
| 2231944 | 6/1974 | France . | |
| 367543 | 12/1979 | Germany . | |
| 9204695 | 8/1992 | Germany . | |
| 1444738 | 11/1973 | United Kingdom . | |
| 1469809 | 4/1977 | United Kingdom | 102/502 |
| 2192258 | 1/1988 | United Kingdom . | |
| 2252612 | 8/1992 | United Kingdom . | |

*Primary Examiner*—Harold J. Tudor
*Attorney, Agent, or Firm*—Dowell & Dowell, P.C.

[57] ABSTRACT

A baton projetile comprises a case (1) of low density polyethylene, and a core (2) of a soft material such as a thermoplastic gel modified rubber. An air gap (4) is optionally formed at the front end of the baton projectile between the core (2) and the case (1). Upon impact with a target at acceptable forces the air pocket (4) reduces the speed of sound of the impact shockwave to reduce the risk of unaccepeable bone injury to the target. At higher than acceptable impact forces, the case (1) ruptures and the core (2) spreads out to radially disperse the excess impact energy and to present a larger impact area to the target so that the risk of unacceptable penetration and trauma injury to the target is reduced.

18 Claims, 1 Drawing Sheet

BATON PROJECTILE

CROSS REFERENCE TO RELATED APPLICATIONS

This application is a continuation of application Ser. No. 08/571,962, filed Jun. 5, 1996, now abandoned, which is a 371 of PCT/GB94/01377 filed Jun. 27, 1994.

BACKGROUND OF THE INVENTION

1. Field of the Invention

This invention is directed to baton projectiles of the type used to direct a non-damaging impact force on a target.

2. History of the Related Art

Baton missiles or projectiles are provided to the police and security forces for use in controlling violent demonstrators or other offenders. Although the intention of using such a projectile is to subdue an offender without causing death or serious injury, the known baton projectiles have not been found to be entirely satisfactory in this respect.

A problem is that there is a conflict between the design requirements of an ideal baton projectile. The ideal projectile should be sufficiently strong to resist the force applied by the propellent used to launch it, but flexible enough to avoid causing sericus injury to the body of the target. Hitherto, pyrotechnic propellants have been used to launch the projectile from a gun, but even the most suitable pyrotechnic propellants tend to cause damage to the preferred types of projectile. The projectile must, in any event, produce an impact of about 200 foot-pounds ( about 270 Joules Kg/meter) in order to subdue a person weighing about 12 stones (about 76 Kg)

Three properties of the impact of known baton projectiles on human targets have been found to contribute to injury and sometimes death. Firstly, the physical trauma of the impact force on the target can induce shock which can result in death if the impact force exceeds certain limits. In the past this has meant that baton projectiles had to be used from a distance of at least 25 meters, with a usable range up to 50 meters to ensure that the impact force would be below lethal levels but the required impact energy would still be achieved. Secondly, the impact of the baton on the target transmits a shockwave into the target which can causes shattering of the target, e.g. the bone of a human target, depending upon the nature of the impact shockwave. In particular, it has been found that a high speed of sound of the impact shockwave can lead to serious shattering of the bones of a human target. Thirdly, at impact energies above the acceptable levels penetration can cause unacceptable injury to vital organs in human targets.

It would be desirable to provide a baton projectile which overcomes or at least alleviates the above-mentioned problems.

SUMMARY OF THE INVENTION

According to the present invention there is provided a baton projectile having a casing which encloses a core, the casing being relatively thin when compared with the diameter of the core and being formed, at least in part, from a substance capable of maintaining the structural integrity of the casing during launch and flight and the core being formed, at least in part, from a relatively soft material so that impact of the baton projectile with a target does not cause unacceptable injury.

BRIEF DESCRIPTION OF THE DRAWINGS

An embodiment of the present invention will row be described, by way of example only, with reference to the accompanying drawings, in which.

DESCRIPTION OF THE PREFERRED EMBODIMENT

Figure 1:
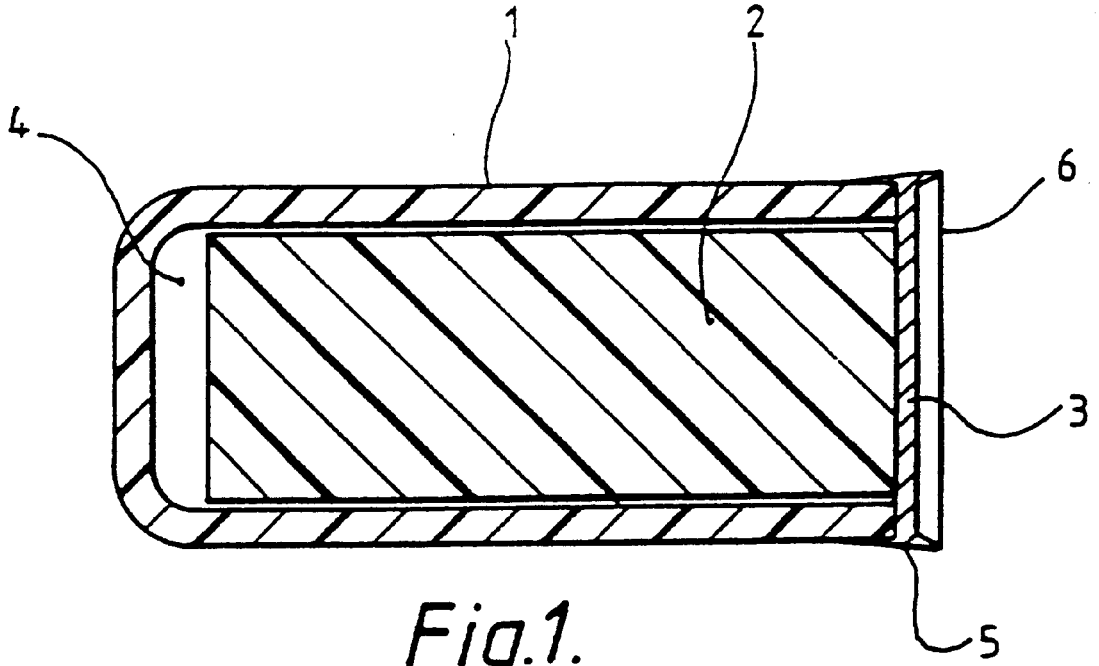
FIG. 1 shows an axial section through a baton projectile forming an embodiment of the present invention.
Figure 2:
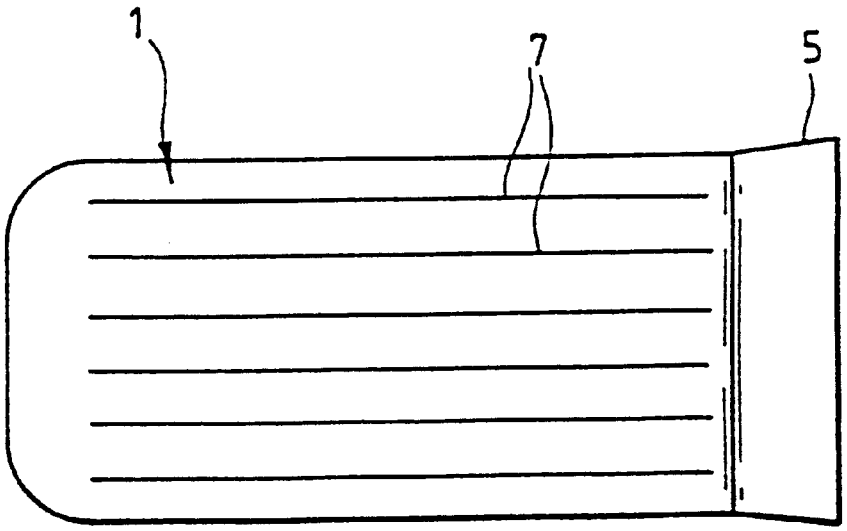
FIG. 2 is a side view of the baton of FIG. 1.

The baton projectile shown in the figures comprises a low density polyethylene case 1 which surrounds and holds in place a synthetic thermoplastic rubber core 2. The case 1 has a rounded front end and the core 2 has a planar front face so that an air pockek 4 is formed in front of the core 2 when loaded in the case 1. The case 1 is closed at its rear end by a sabot 3. The case 1 is relatively thin when compared with the diameter of the core and the polyethylene from which it is formed has a softening point of no less than auout 60 degrees centigrade to ensure that the projectile will function satisfactorily under all expected operating temperatures.

The compcsiticns and physical characteristics c the materials used for the case and core may be varied in order to select a desired impact specification.

The core 2 is formed from a synthetic thermoplastic rubber material which is gel modified so as to have a desired viscosity.

The viscosity of the core can be varied to change the nature of the impact shockwave. In most applications, the viscosity of the core is chosen so that the speed of sound of the impact shockwave is low and thus the risk of shattering of the bones of a human target is reduced in comparison with the prior art.

The air pocket 4 between the front face of the casing and the core tends to cushion the core, as it moves forward, when the projectile impacts on the target to produce a modified shockwave. The provision of the air pocket 4 further reduces the risk of bone shattering of a human target, compared with a projectile in which the core fills the casing.

The thickness and strength of the case 1 are predetermined having regard to the characteristics of the core, the maintenance of the integrity of the case during the launch and flight phases, and the criteria of the impact to be achieved.

The parameters of the case 1, and in particular its thickness and strength are chosen so as to ensure that, upon impact at high forces i.e. when launched at short range, the case deforms to allow the core to cause no more than an acceptable degree of injury to the body of the target. The impact force is thus kept at acceptable levels and the baton is prevented from penetrating and causing unacceptable injury to vital organs of the target.

Furthermore, the case 1 and core 2 are designed so that the case ruptures, without breaking into sharp fragments, in the event of an excessive impact force, usually above 200 foot-pounds. Such impact forces might occur if the baton if fired at very close range. The gel modified synthetic rubber used for the core is so compounded that when the case ruptures, the core flows or spreads radially outwards from the pont of impact and tends to flatten itself against the body of the target, again without penetration of the target. A significant force is thereby applied by the core to the target over an area greater than that of the projectile itself, and by means of a relatively soft material. In this way the excess impact energy is dispersed to reduce the risk of unacceptable injury to the target.

The exterior of the case 1 has optional striations 7 which help to promote the rupturing of the case at high impact forces.

A range of color coded outwardly physically identical projectiles may therefore be manufactured, each with a different impact specification. Because the compositions of the materials used for the case and core can be precisely controlled, and the dimensions of the projectile accurately reproduced by molding techniques, projectiles for each specification can be reliably mass produced.

Materials other than low density polyethylene such as other plastics or synthetic wax may be used for the case, and materials other than thermoplastic rubber may be used for the core. However, the material used for the case must meet the requirements of allowing the case to deform, and rupture at high impact forces, without breaking into dangerous fragments, and that used for the core must be capable of spreading to form a relatively soft mass which will not penetrate the body of the target at such high impact forces. The components should possess these characteristics when impacting on the target with high impact forces being defined as impacts of above around 200 foot-pounds. Thus any suitable plastics, wax, synthetic wax or wax-like material may be used for the case, and compounds of rubber, synthetic or rubber-like material may be used for the core, provided the materials will meet these requirements. Other materials which meet the specified requirements may also be used.

Examples of suitable materials for the core are:

thermoplastic elastomer compounds based on styrene ethylene-butylene styrene (SOS), styrene ethylene-propylene styrene (SEPS), styrene butadiene styrene (SBS) block polymers, compounded with paraffinic or naphthenic oil, inorganic fillers such as calcium carbonate, silica, talc, barium sulphate and a suitable stabiliser system.

The SEBS or SEPS would be modified with the addition of a polyolefin such as polyethylene, polypropylene or copolymer of these. The SBS could be modified by the addition of polyethylene, polypropylene, copolymers of these, ethylene vinyl acetate or polystyrene.

Typically the compositions would be within the following range:

| | (% by weight) |
|---|---|
| TPE polymer (SEBS, SEPS or SBS) | 10 to 40% |
| Oil (paraffinic or naphthenic) | 20 to 75% |
| Filler (CaCO3, silica, talc, barytes) | 0 to 80% |
| Modifier (polyolefin, eva, polystyrene) | 3 to 55% |
| Stabilisers | 0.1 to 1% |

Density would range from 0.88 to 2.4 $gcm^{-3}$.

Hardness would range from less than 20 Shore A.

To improve its accuracy, the projectile is spin-stabilised in flight. The projectile is caused to spin by cooperation of the sabot 3 with the rifling of the barrel from which the projectile is launched. The sabot is of relatively rigid construction and has a skirt 5 which is sleeved over the rear end of the case and a base 6 which obturates the end of the case and retains the core. The sabot receives and distributes the forces applied to the projectile during the launch phase and prevents damage to the casing during this phase.

The material of the case enables it to maintain its structural integrity during the launch and flight phases and may be printed with information on its exterior.

Although the projectile may be launched using a conventional pyrotechnic cartridge, the impact characteristics and reliability of the projectile described herein may be improved, if it is launched from a pressurised gas cartridge, particularly although not essentially of the type described in my European patent application No. 92200396.7.

The baton according to the present invention has the advantage that it can be used within close and very close range from a target. In particular it can be used at distances below 25 meters without causing unacceptable injury to a human target. As with the prior art the baton of the invention can be used up to 50 meters or more from the target.

It will be appreciated that many variations and modifications may be made to the described embodiment and it is intended to include all such variations and modifications as fall within the scope of the accompanying claims. In particular, the core may fill the casing.

What is claimed is:

1. A baton projectile comprising:

a core formed from a deformable solid material;

a casing enclosing said core, said casing having a front wall, a rear wall and side walls, which walls are thin when compared with a diameter of said core, said casing being formed from a material which maintains the structural integrity of said walls of said casing during launch from a baton gun and flight of the projectile and upon impact with a target at impact energies less than 200 foot-pounds;

wherein said deformable solid material of said core is relatively soft when compared with said material of said casing;

said core and said casing being dimensioned to permit forward movement of said core within said casing and to define an air pocket inside said casing between said front wall of said casing and said core;

whereby upon impact of the baton projectile on a target at impact energies less than 200 foot-pounds, said casing deforms and said core causes an impact shockwave to the target, the impact of said core being cushioned by said air pocket so that the shockwave does not cause unacceptable injury to the target.

2. A baton projectile as claimed in claim 1, in which said walls of said casing are formed so as to rupture on impact with the target at impact energies above a predetermined value to release said core from said casing.

3. A baton projectile as claimed in claim 2, in which the material of the said core has a shore hardness of less than 20 A.

4. A baton projectile as claimed in claim 2, in which the predetermined value is 200 foot-pounds.

5. A baton projectile as claimed in claim 2, in which said walls of said casing are formed from a low density polyethylene.

6. A baton projectile as claimed in claim 2, in which the core is formed form a thermoplastic gel modified rubber.

7. A baton projectile as claimed in claim 2, including a sabot fitted upon said rear end of said casing.

8. A baton projectile as claimed in claim 1, in which said walls of said casing are formed so as to rupture on impact with the target at impact energies above a predetermined value to release said core without said walls forming fragments capable of penetrating the target, and said material of said core is of a consistency to spread out to form a larger impact area with the target.

9. A baton projectile as claimed in claim 8, in which the material of the said core has a shore hardness of less than 20 A.

10. A baton projectile as claimed in claim 9 in which the predetermined value is 200 foot-pounds.

11. A baton projectile as claimed in claim 9, in which said walls of said casing are formed from a low density polyethylene.

12. A baton projectile as claimed in claim 9, in which said core is formed from a thermoplastic gel modified rubber.

13. A baton projectile as claimed in claim 9, including a sabot fitted upon said rear end of said casing.

14. A baton projectile as claimed in claim 1, in which said walls of said casing are formed so as to rupture on impact with the target at impact energies above a predetermined value to release said core without said walls forming fragments capable of penetrating the target.

15. A baton projectile as claimed in claim 1, in which the material of the said core has a shore hardness of less than 20 A.

16. A baton projectile as claimed in claim 1, in which said core is formed from a thermoplastic gel modified rubber.

17. A baton projectile as claimed in claim 1, in which said walls of said casing are formed from a low density polyethylene.

18. A baton projectile as claimed in claim 1, including a sabot fitted upon said rear end of said casing.

* * * * *